US008395331B2

(12) United States Patent
Volk et al.

(10) Patent No.: US 8,395,331 B2
(45) Date of Patent: Mar. 12, 2013

(54) AUTOMATIC DROPOUT PREVENTION IN LED DRIVERS

(75) Inventors: Karl Richard Volk, Scotts Valley, CA (US); Thomas Joseph Karpus, Cary, NC (US); David Paul Keesor, Chapel Hill, NC (US); Russell Coleman Deans, Chapel Hill, NC (US); Paul Edward Hinson, Carrboro, NC (US)

(73) Assignee: Semtech Corporation, Camarillo, CA (US)

( * ) Notice: Subject to any disclaimer, the term of this patent is extended or adjusted under 35 U.S.C. 154(b) by 207 days.

(21) Appl. No.: 12/898,547

(22) Filed: Oct. 5, 2010

(65) Prior Publication Data

US 2012/0081036 A1 Apr. 5, 2012

(51) Int. Cl.
*H05B 37/02* (2006.01)

(52) U.S. Cl. ..... 315/297; 315/307; 315/312

(58) Field of Classification Search ..... 315/185 R, 315/291, 294, 297, 299, 307, 308, 312
See application file for complete search history.

(56) References Cited

U.S. PATENT DOCUMENTS

| | | | | |
|---|---|---|---|---|
| 7,436,378 | B2 * | 10/2008 | Ito et al. | 345/82 |
| 8,115,414 | B2 * | 2/2012 | Zhao et al. | 315/299 |
| 2002/0047642 | A1 * | 4/2002 | Miyagawa | 315/307 |
| 2003/0227265 | A1 * | 12/2003 | Biebl | 315/291 |
| 2004/0233144 | A1 * | 11/2004 | Rader et al. | 345/82 |
| 2008/0297067 | A1 * | 12/2008 | Wang et al. | 315/294 |
| 2009/0179589 | A1 * | 7/2009 | Buhler et al. | 315/297 |
| 2010/0013412 | A1 * | 1/2010 | Archibald et al. | 315/294 |

* cited by examiner

*Primary Examiner* — Tung X Le
(74) *Attorney, Agent, or Firm* — O'Melveny & Myers LLP

(57) ABSTRACT

A system and method is provided for preventing a dropout of an LED current. In one embodiment of the present invention, the system includes a voltage source, a first circuit, a second circuit, a controller, and at least one LED. The first circuit receives a reference voltage from the voltage source, receives set-point current data from the controller, and uses the reference voltage and the set-point current data to produce a threshold voltage. The threshold voltage is then provided to the second circuit, where it is converted into an output current, which is drawn through the LED. The second circuit then compares the threshold voltage to an output voltage corresponding to the output current, and provides an output to the controller. The controller then uses the output to determine whether a dropout has occurred. If a dropout has occurred, then second set-point current data is provided to the first circuit.

30 Claims, 6 Drawing Sheets

AUTOMATIC DROPOUT PREVENTION IN LED DRIVERS

BACKGROUND OF THE INVENTION

1. Field of the Invention

The present invention relates to light-emitting diodes (LED) drivers, or more particularly, to a system and method for preventing automatic dropout in an LED driver if an output current (or voltage) cannot be maintained.

2. Description of Related Art

Light-emitting diodes (LEDs) can be found in many different types of technologies, including flashlights, Christmas lights, and electronic devices. For example, LEDs are commonly used as backlights (e.g., edge-lit, array, etc.) for electronic devices having a liquid crystal display (LCD) (e.g., laptop computers, PDAs, cellular telephones, MP3 players, etc.).

When LEDs are used in electronic devices, steps are generally taken to ensure that the LEDs are provided with sufficient power. For example, an LED voltage driver might be used to provide a threshold voltage (e.g., 3.6 volts) to an LED. A problem arises, however, when a battery source for the electronic device is unable to provide the required threshold voltage. This may be due to the battery source being depleted, either as a result of time or the application of a load.

If the output voltage of the LED driver drops too low, it can cause individual LEDs to appear dim or inactive. This is because each LED has its own electrical characteristics. For example, a first LED may draw 20 mA at 3.3 volts, whereas a second LED may draw 15 mA at 3.3 volts. Because current in an LED is directly proportional to an amount of light produced, low voltage can result in an LED backlight having a non-uniform appearance (i.e., certain LEDs appear brighter than others). Also, if the voltage drop is due to a temporary load, then the LEDs may appear as if they are blinking (e.g., dimming when a load is applied, and increasing when the load is removed).

One way of solving this problem is to use a circuit (e.g., a capacitive charge pump, an inductive boost, etc.) to increase voltage. However, such a circuit adds cost to the device, and may require a relatively large package. Thus, in a world where devices are generally smaller and less expensive, many manufactures are reluctant to add such a circuit.

Another way of solving this problem is to monitor the LED voltage driver, and power down the electronic device if the output voltage of the LED voltage driver drops below a threshold voltage (e.g., 3.6 volts). While this ensures that the LED backlight is uniform when it is functional, it results in a shortened battery life (or at least an appearance of a shortened battery life), since the device is powered down after the voltage threshold can no longer be maintained.

Accordingly, it would be advantageous to provide a circuit that would prevent an automatic dropout in an LED driver if an output current (or voltage) cannot be maintained. Such a circuit, for example, would allow the device (e.g., portable electronic device, etc.) to continue to run at a reduced and regulated current (or voltage), thereby producing a light source even if an initial output current (or voltage) cannot be maintained.

SUMMARY OF THE INVENTION

The present invention provides a system and method for preventing a dropout of a light-emitting diode (LED) current or voltage. Preferred embodiments of the present invention operate in accordance with an electronic circuit configured to convert an input current into a first output current, as set by a controller, and to determine whether the circuit is capable of producing (or maintaining) the first output current. If the circuit is not capable of producing (or maintaining) the first output current, then a second output current is produced. The second output current is set by the controller and is less than the first output current.

In a first embodiment of the present invention, the circuit includes a current source configured to provide a reference current ($I_{ref}$), a converter configured to convert the reference current into a reference voltage, a first circuit configured to receive the reference voltage, a second circuit connected to the first circuit, a logic controller connected to the first and second circuits, and at least one LED connected to the second circuit. The first circuit is configured to receive the reference voltage from the converter (or an alternate voltage source), to receive set-point current data from the logic controller, and to use the reference voltage and the set-point current data to produce a threshold voltage ($V_{thres}$). The threshold voltage is then provided to the second circuit, where it is converted into an output current, which is drawn through the LED.

The second circuit is further configured to compare the threshold voltage to an output voltage corresponding to the output current, and to provide an output to the logic controller that is indicative of a relationship between the threshold voltage and the output voltage. The logic controller is then configured to use the output to determine whether a dropout has occurred. If a dropout has occurred, then second set-point current data is provided to the first circuit, wherein the second set-point current data corresponds to a second output current that is (preferably) lower than the output current. The second set-point current data is used by the first circuit to produce a second threshold voltage in the same manner as described above, and the second threshold voltage is used to provide a second output current and a second output in the same manner as described above. If the second output indicates that a dropout has occurred, then third set-point current data is provided to the first circuit, and the process is repeated until there is no longer a dropout. By performing this process iteratively, an output current can be identified that is the largest output current that can be produced based on the amount of available power, thereby resulting in the brightest possible LED(s).

In one embodiment of the present invention, the first circuit includes a plurality of multipliers, a decoder and a current controlled voltage source, wherein the reference voltage is provided to each multiplier, and the set-point current data is provided to the decoder and used to activate individual ones of the multipliers. Each multiplier is configured to produce an output current, and the current controlled voltage source is configured to convert the output current into an output voltage that is a multiple of the reference voltage. If multiple multipliers are activated, then their cumulative output currents are converted into a cumulative output voltage that is a multiple of the reference voltage.

In another embodiment of the present invention, the second circuit includes a first device (e.g., buffer, amplifier, etc.), a comparator, and a voltage controlled current source, wherein the first device is configured to receive the threshold voltage and to produce an output voltage, wherein the output voltage is either substantially equal or greater than the threshold voltage. The output voltage is then provided to the comparator and the voltage controlled current source. The voltage controlled current source is configured to convert the output voltage into an output current ($I_{load}$), which is drawn through the LED. By producing an output current, as opposed to an output voltage, multiple LEDs having different voltage characteristics can be driven to produce outputs (La, lights) that are substantially similar (e.g., substantially uniform in brightness). The comparator is configured to receive the output voltage and the threshold voltage and to produce an output that is indicative of a relationship between the threshold voltage and the output voltage.

In a second embodiment of the present invention, the electronic circuit includes a plurality of second circuits for driving a plurality of LEDs, wherein each second circuit provides an output to the logic device that is indicative of a relationship between the threshold voltage and an output voltage corresponding to the output current. The logic controller is configured to determine (via the plurality of outputs) whether there has been a dropout in any of the second circuits. If there has, set-point current data (e.g., second set-point current data, etc.) is provided to the first circuit, thereby lowering the output current produced by each of the second circuits. This is done to maintain uniformity in the plurality of LEDs.

In a third embodiment of the present invention, each second circuit is configured to produce an output indicative of either a logic zero or a logic one. The outputs are then provided to a logical OR circuit, the output of which is provided to the logic controller and used to determine whether there has been a dropout in any of the second circuits. If there has, then set-point current data (e.g., second set-point current data, etc.) is provided to the first circuit, thereby lowering the output current produced by each one of the second circuits.

In another embodiment of the present invention, a method is performed to prevent a dropout of an LED current or voltage. Specifically, set point current data is provided, wherein the set-point current data corresponds to a particular output current. A reference voltage and the set-point current data are then used to generate a threshold voltage, which is converted into an output current. This can be done, for example, by converting the threshold voltage into an output voltage, and converting the output voltage into the output current. The output current is then drawn through at least one LED. The threshold voltage is then compared to an output voltage that corresponds to the output current. This results in an output that is indicative of a relationship between the threshold voltage and the output voltage. If it is determined (via the output) that there has been a dropout (i.e., that the voltage necessary for generating the output current cannot be produced), then second set-point current data is provided, wherein the second set-point current data corresponds to a second output current that is (preferably) less than the output current. Finally, the second set-point current data is used to generate a second threshold voltage, which is used to generate a second output current. The second output current is then drawn through the at least one LED.

A more complete understanding of a system and method for preventing automatic dropout of an LED current or voltage will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for preventing a dropout of a light-emitting diode (LED) current or voltage. In the detailed description that follows, like element numerals are used to describe like elements illustrated in one or more figures.

Figure 1A:
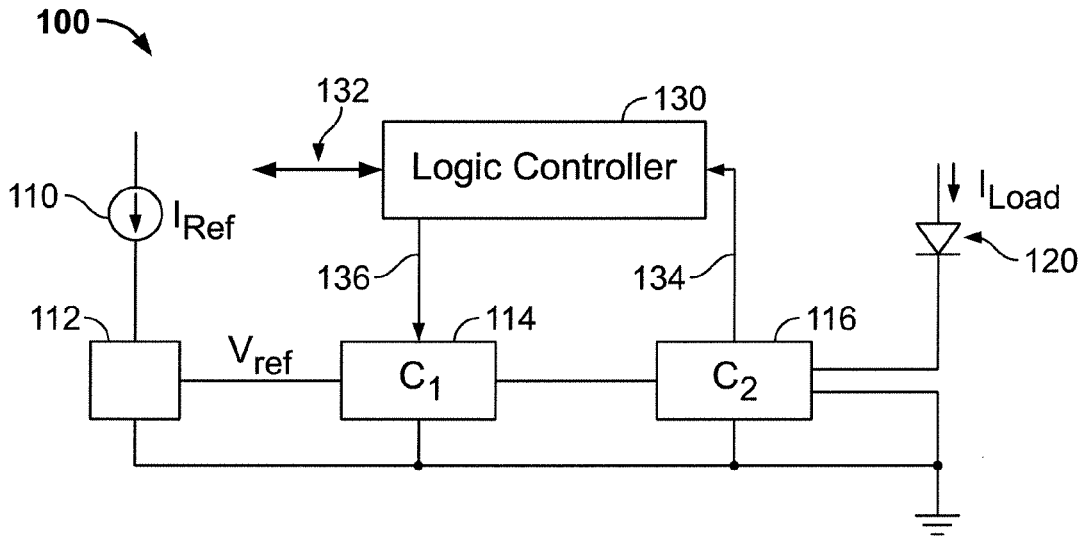
FIG. 1*a* illustrates an electronic circuit for preventing dropout of an LED current or voltage in accordance with a first embodiment of the present invention, the circuit including at least a logic controller, a first circuit (C1) and a second circuit (C2)

In a first embodiment of the present invention, as shown in FIG. 1*a*, the system includes an electronic circuit 100 for preventing a dropout of an LED current or voltage. Specifically, the electronic circuit 100 includes a current source 110 providing a reference current ($I_{ref}$), a converter 112 for converting the reference current into a reference voltage ($V_{ref}$), a first circuit 114 ($C_1$) configured to receive the reference voltage, a second circuit 116 ($C_2$) connected to the first circuit 114, a logic controller 130 connected to the first and second circuits 114, 116, and an LED 120 connected to the second circuit. It should be appreciated, however, that the present invention is not limited to the electronic circuit illustrated in FIG. 1*a*, and includes circuits that include additional, fewer or different components. For example, a circuit that does not include an LED, but is configured to be electrically connected to at least one LED is within the spirit and scope of the present invention. By way of another example, a circuit that includes (or is configured to be connected to) a voltage source instead of a current source is with in the spirit and scope of the present invention. Such an embodiment may alleviate the need for the converter 112.

As shown in FIG. 1*a*, the first circuit 114 is configured to receive the reference voltage ($V_{ref}$) from the converter 112 (or an alternate voltage source) and to receive set-point current data from the logic controller 130 via line 136. The set-point current data may either be generated by the logic controller 130 or provided to the logic controller 130 via a communication bus 132, for example from an external device (e.g., external controller, user interface, etc.) (not shown). In a preferred embodiment of the present invention, the set-point current data is a digital signal comprising at least one bit (e.g., four-bit set-point current data, eight-bit set-point current data, etc.).

The first circuit 114 is further configured to use the reference voltage and the set-point current data to produce a threshold voltage ($V_{thres}$). The threshold voltage is then provided to the second circuit 116.

Figure 2:
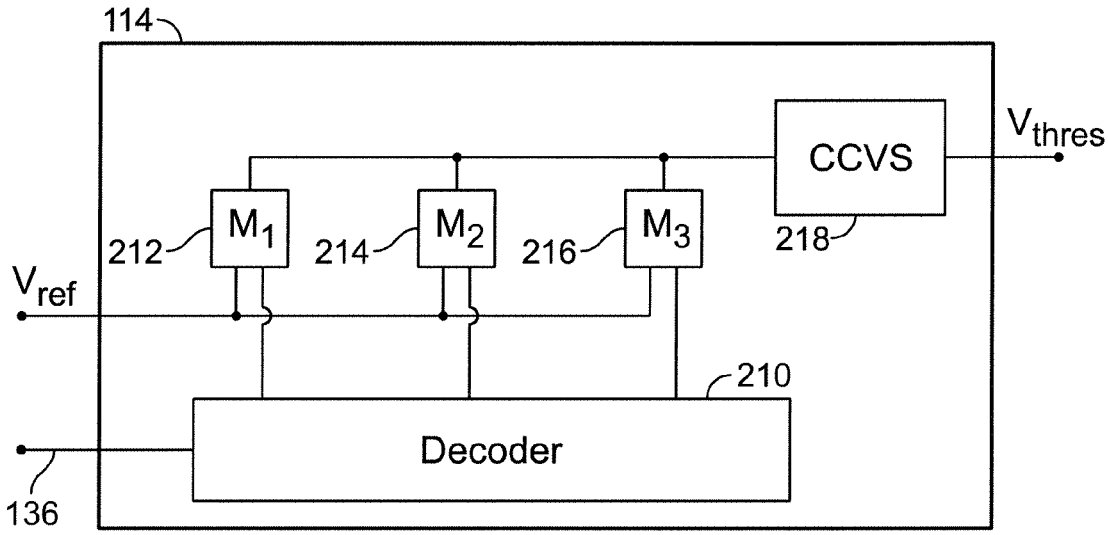
FIG. 2 illustrates an exemplary embodiment of the first circuit (C1), as depicted in FIG. 1*a;*

An exemplary first circuit 114 is shown in FIG. 2. Specifically, the circuit 114 includes a plurality of multipliers 212, 214 and 216, a decoder 210 and a current controlled voltage source 218, wherein the reference voltage ($V_{ref}$) is provided to each multiplier 212, 214 and 216, and the set-point current data is provided to the decoder 210 and used to activate individual ones of the multipliers (e.g., 212, 214, etc.). Each multiplier is configured to produce an output current, and the current controlled voltage source 218 is configured to convert the output current into an output voltage that is a multiple of the reference voltage. If multiple multipliers are activated, then their cumulative output currents are converted into a cumulative output voltage that is a multiple of the reference voltage. For example, if each multiplier is configured to produce a current corresponding to a voltage that is ten times the reference voltage, and a single multiplier is activated, then the cumulative output (or threshold) voltage would be $10\times V_{ref}$. However, if two multipliers are activated, then the cumulative output (or threshold) voltage would be $20\times V_{ref}$. Three activated multipliers would yield $30\times V_{ref}$, etc.

It should be appreciated, however, that the present invention is not limited to the circuit illustrated in FIG. 2, and includes circuits that include additional, fewer and different components. For example, any circuit configured to use a provided set of data (e.g., set-point current data) to convert a reference voltage into a threshold voltage, wherein the threshold voltage is greater than the reference voltage, is within the spirit and scope of the present invention. By way of another example, a circuit that includes additional or fewer multipliers, includes multipliers having different output-to-input ratios (e.g., 2:1, 10:1, 100:1, etc.) and/or does not include a current controlled voltage source, is within the spirit and scope of the present invention.

Referring back to FIG. 1*a*, the threshold voltage ($V_{thres}$) is provided to the second circuit 116. The second circuit 116 is configured to receive the threshold voltage, convert the threshold voltage into an output current, and provide the output current to the LED 120. In one embodiment of the present invention, the second circuit 116 is further configured to compare the threshold voltage to an output voltage corresponding to the output current, and to provide an output to the logic controller 130, wherein the output is indicative of a relationship between the threshold voltage and the output voltage.

Figure 3:
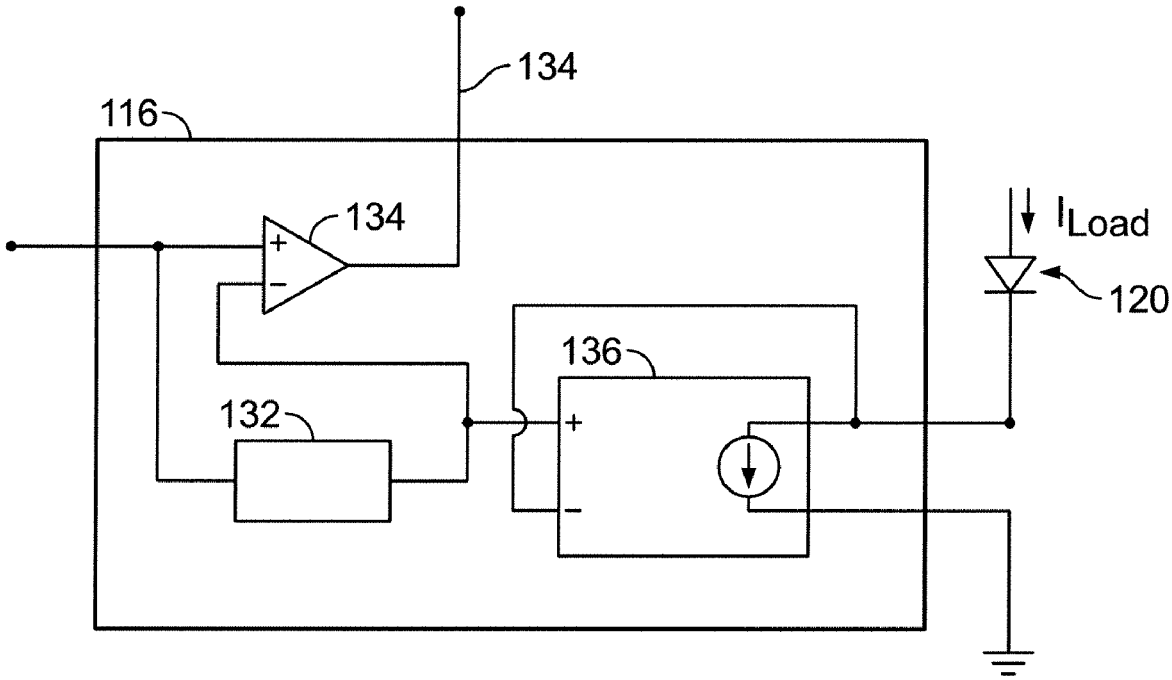
FIG. 3 illustrates an exemplary embodiment of the second circuit (C2), as depicted in FIG. 1*a;*
Figure 4:
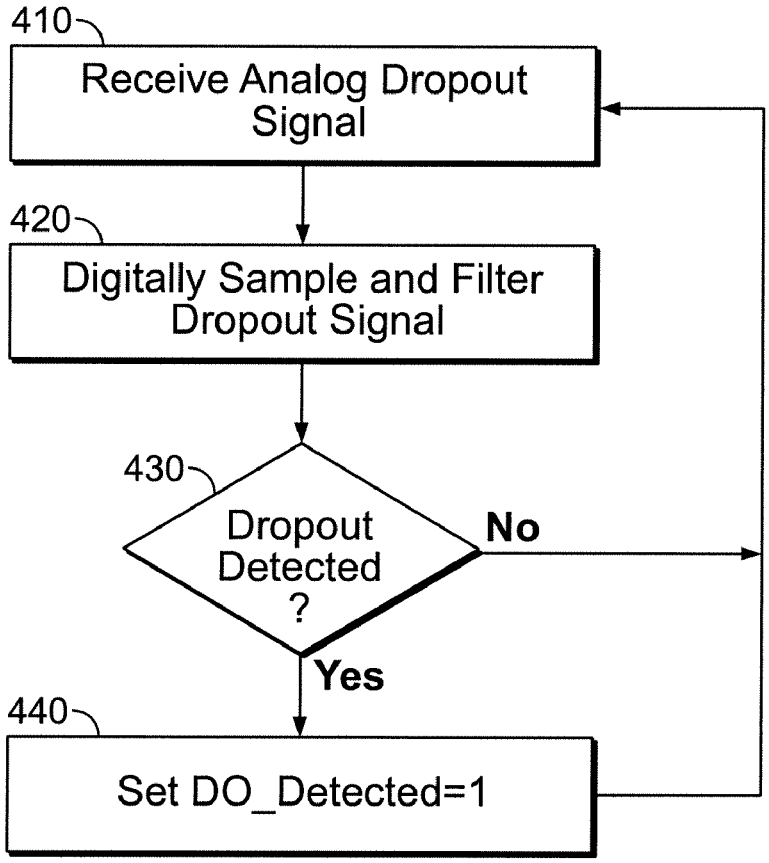
FIG. 4 illustrates a first portion of a method for preventing dropout in accordance with a fourth embodiment of the present invention.

An exemplary second circuit 116 is shown in FIG. 3. Specifically, the circuit 116 includes a first device 132, a comparator 134, and a voltage controlled current source 136, wherein the first device 132 is configured to receive the threshold voltage ($V_{thres}$) and to produce an output voltage, wherein the output voltage is either substantially equal to the threshold voltage or greater than the threshold voltage. For example, the first device 132 may comprise a buffer (e.g., a unity gain buffer) configured to produce an output voltage that is substantially the same as the threshold voltage. By way of another example, the first device 132 may comprises an amplifier configured to produce an output voltage that is greater than (and perhaps substantially proportional to) the threshold voltage. The output voltage is then provided to the comparator 134 and the voltage controlled current source 136.

The voltage controlled current source 136 is configured to convert the output voltage (as provided by the first device) into an output current ($I_{load}$), which is drawn through the LED 120. By producing an output current, as opposed to an output voltage, multiple LEDs having different voltage characteristics can be driven to produce lights that are substantially similar, or substantially uniform in brightness.

The comparator 134 is configured to receive the output voltage (as provided by the first device) and the threshold voltage ($V_{thres}$) and to produce an output that is indicative of a relationship between the threshold voltage and the output voltage. For example, the comparator 134 may be configured to produce a particular voltage (e.g., 3.3 volts, etc.) indicative of a logic one or zero if the output voltage is less than the threshold voltage. By way of another example, the comparator 134 may comprises an error amplifier, and be configured to produce a differential between the output voltage and the threshold voltage.

It should be appreciated, however, that the present invention is not limited to the circuit illustrated in FIG. 3, and includes circuits that include additional, fewer and different components. For example, any circuit configured to convert a threshold voltage into an output current, and to produce an output indicative of a relationship between the threshold voltage and an output voltage corresponding to the output current, is within the spirit and scope of the present invention. By way of another example, a circuit that includes additional devices, does not includes a voltage controlled current source, and/or has a comparator (or the like) that is configured to receive a voltage that corresponds to (or is proportional to) the output voltage or the output current, is within the spirit and scope of the present invention.

Referring back to FIG. 1*a*, the output indicative of the relationship between the threshold voltage and the output voltage is received by the logic controller 130 via line 134. In one embodiment of the present invention, the output is an analog signal. In another embodiment of the present invention, the logic controller 130 is configured to digitally sample and filter the output, to distinguish an actual dropout from a dropout instance, or the appearance of a temporary dropout (e.g., due to noise, the application of a load, etc.). For example, the analog signal may be converted to a digital signal (e.g., via an analog-to-digital converter), sampled and/or filtered. The resulting signal is then compared to a stored (or known) value to determine whether a dropout has occurred. For example, a logic one may indicate that the output voltage has dropped below the threshold voltage. By way of another example, a deferential of a particular voltage (e.g., 2.2 voltage, etc.) may indicate that a dropout has occurred.

If a dropout is detected, the logic controller 130 may be configured to provide second set-point current data to the first circuit 114 via line 136, wherein the second set-point current data corresponds to a current that is lower than the output current, as set by the (first) set-point current data. The second set-point current data is used by the first circuit 114 to produce a second threshold voltage in the same manner as described above, and the second threshold voltage is used to provide a second output current and a second output in the same manner as described above. If the second output indicates that a dropout has occurred, then third set-point current data can be provided to the first circuit 114, and the process can be repeated until a dropout is no longer detected.

For example, assume that first set-point current data corresponds to an output current of 20 mA, second set-point current data corresponds to an output current of 19 mA, third set-point current data corresponds to an output current of 18 mA, and so on. If the first set-point current data is provided to the first circuit 114, then the second circuit 116 will attempt to produce an output current of 20 mA. If an output from the second circuit 116 indicates that the second circuit 116 is not capable of producing an output current of 20 mA, then the second set-point current data will be provided to the first circuit 114, and the second circuit 116 will attempt to produce an output current of 19 mA. If a second output from the second circuit 116 indicates that the second circuit 116 is not capable of producing an output current of 19 mA, then the third set-point current data will be provided to the first circuit 114, and the second circuit will attempt to produce an output current of 18 mA. This continues until the second circuit 116 is capable of producing an output current, as set by the set-point current data. By performing this process iteratively, an output current can be identified that is the largest output current that can be produced, based on the amount of power available from the battery source, thereby resulting in the brightest possible LED, or the brightest possible LEDs.

It should be appreciated that if the output current drops below a predetermined threshold, the logic controller may be configured to deactivate the first and/or second circuits. This can be done by either providing a deactivation signal to the first circuit, providing a deactivation signal to the second circuit, and/or providing set-point current data corresponding to an output current of substantially zero to the first circuit.

As discussed above, the second circuit can be used to driver at least one LED (e.g., one LED, a plurality of LEDs, etc.). However, it may be advantageous to use a plurality of second circuits to drive a plurality of LEDs. For example, as shown in FIG. 1*b*, the electronic circuit may include a plurality of second circuits 116*a*, 116*b* and 116*c* for driving a plurality of LEDs 120*a*, 120*b* and 120*c*, wherein each second circuit (e.g., 116*a*) provides an output to the logic device 130 indicative of a relationship between the threshold voltage (as provided by the first circuit) and an output voltage corresponding to the second circuit's output current.

Figure 1B:
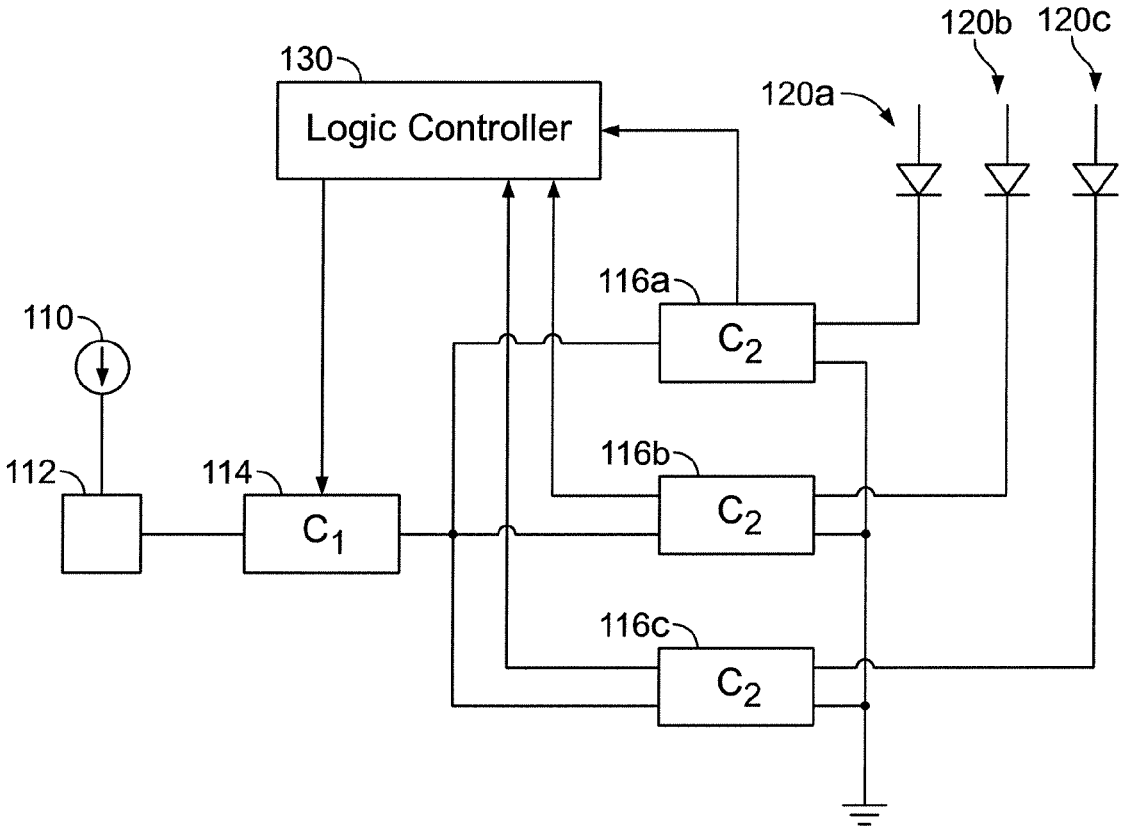
FIG. 1*b* illustrates an electronic circuit for preventing dropout of an LED current or voltage in accordance with a second embodiment of the present invention.

In FIG. 1*b*, the logic controller 130 may be configured determine (via the plurality of outputs) whether there has been a dropout in any of the second circuits. If there has, set-point current data (e.g., second set-point current data, etc.) would be provided to the first circuit, thereby lowering the output current produced by each of the second circuit. For example, if first set-point current data corresponds to an output current of 20 mA, second set-point current data corresponds to an output current of 19 mA, and the second circuit 116*a* is not capable of producing an output current of 20 mA, then second set-point current data will be provided to the first circuit 114, and each one of the second circuits 116*a*, 116*b* and 116*c* will attempt to produce an output current of 19 mA. This is true regardless of whether the remaining second circuits (e.g., 116*b* or 116*c*) are capable of producing an output current of 20 mA. This is done to maintain uniformity in the plurality of LEDs 120*a*, 120*b* and 120*c*.

Figure 1C:
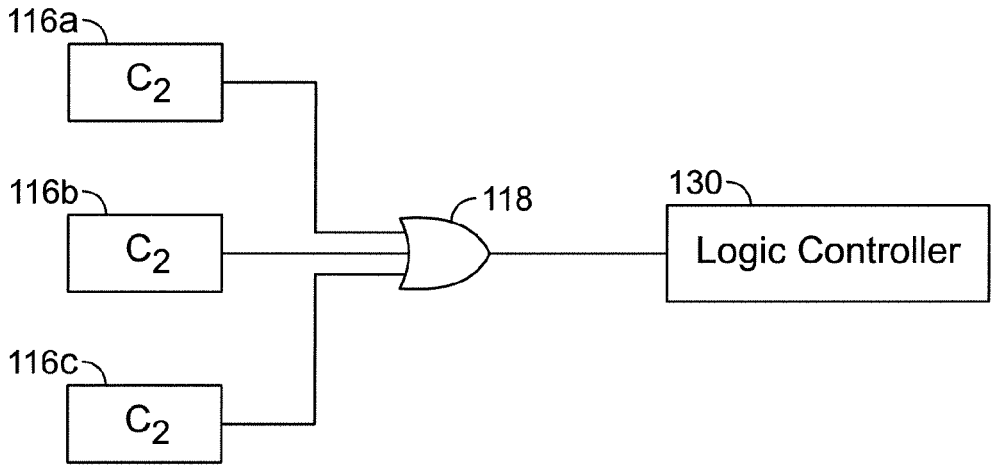
FIG. 1*c* illustrates an electronic circuit for preventing dropout of an LED current or voltage in accordance with a third embodiment of the present invention.

As before, it should be appreciated that the present invention is not limited to the circuit shown in FIG. 1*b*. For example, a circuit that does not include, but is configured to drive, a plurality of LEDs, where each second circuit drives at least one LED, is within the spirit and scope of the present invention. It should also be appreciated that if the outputs of the second circuits are digital values (e.g., logic ones, logic zeros, etc.), then a logical OR circuit 118, as shown in FIG. 1*c*, could be used to identify whether there has been a dropout in any of the second circuits. As shown in FIG. 1*c*, the output of the logical OR circuit 118 is provided to the logic controller 130, and can be used to determine whether there has been a dropout in any of the second circuits.

Figure 8:
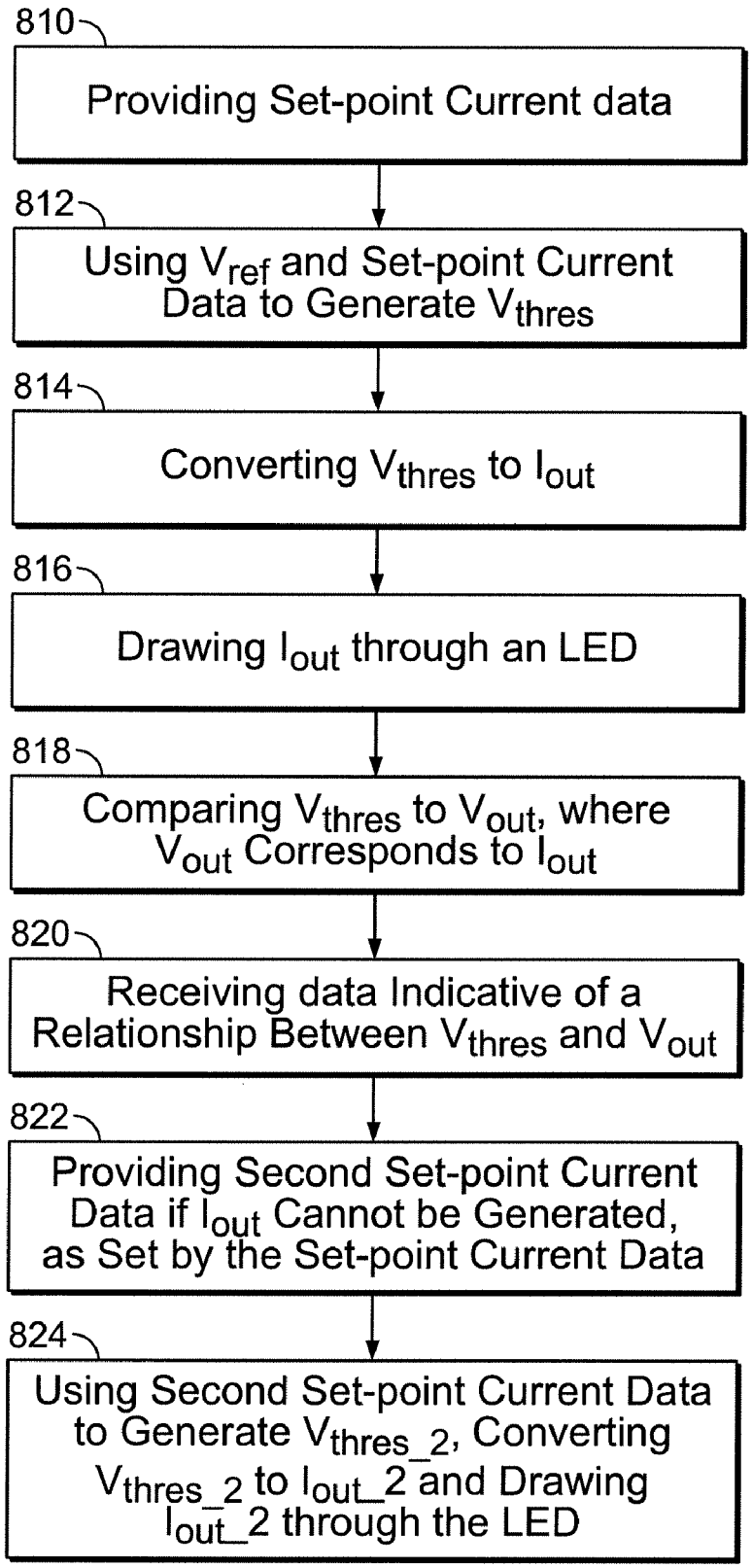
FIG. 8 illustrates a method for preventing dropout of an LED current or voltage in accordance with a fifth embodiment of the present invention.

An iterative method for preventing a dropout of an LED current or voltage in accordance with one embodiment of the present invention is illustrated in FIG. 8. Specifically, set point current data is provided at step 810. In a preferred embodiment, the set-point current data corresponds to a particular output current. A reference voltage and the set-point current data are used to generate a threshold voltage at step 812. At step 814, the threshold voltage is converted into an output current. This can be done, for example, by converting the threshold voltage into an output voltage, and converting the output voltage into the output current. The output current is then drawn through at least one LED at step 816. At steps 818 and 820, the threshold voltage is then compared to an output voltage, wherein the output voltage corresponds to the output current, and an output indicative of a relationship between the threshold voltage and the output voltage is provided to a controller. At step 822, if it is determined (via the output) that there has been a dropout (i.e., that the voltage necessary for drawing the output current through the LED cannot be produced), then second set-point current data is provided. In a preferred embodiment, the second set-point current data corresponds to a second output current that is less than the output current. Finally, at step 824, the second set-point current data is used to generate a second threshold voltage, which is used to generate a second output current, which is drawn through the LED.

Referring to FIGS. 4-7, the logic controller may be configured to perform a plurality of methods (or portions thereof), depending on the signals received (e.g., from the second circuit, an external controller, a user interface, etc.). For example, in FIG. 4, the logic controller may be configured to receive an analog signal from the second circuit at step 410. The signal is then digitally sampled (or converted into a digital signal) and filtered at step 420. At step 430, the controller uses the digitally sampled and filtered signal to determine whether a dropout has occurred. If a dropout has not occurred, then the process starts again at step 410. If a dropout has occurred, then a register DO_detected is set high (or to one) at step 440.

Figure 5:
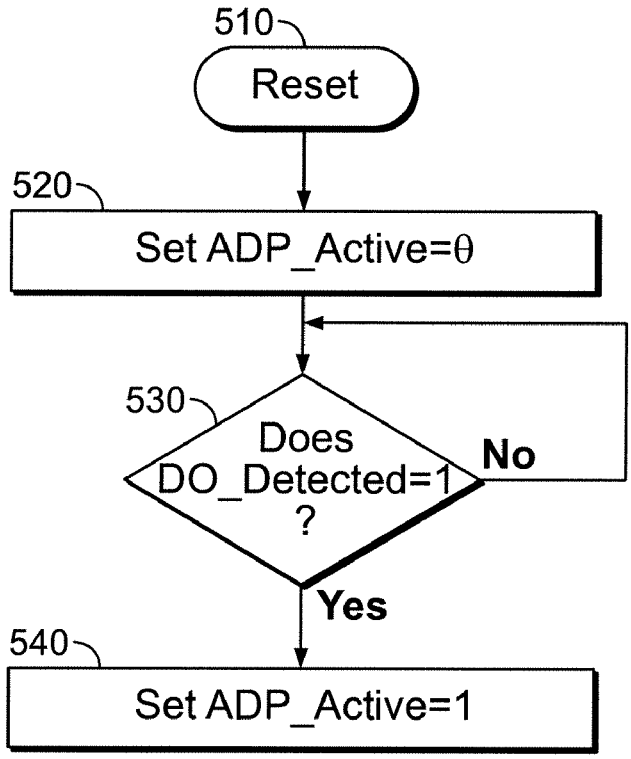
FIG. 5 illustrates a second portion of the method for preventing dropout in accordance with the fourth embodiment of the present invention.

In FIG. 5, in response to a reset at step 510, a register ADP_active is set low (or to zero), indicating that the automatic dropout protection is inactive. At step 530, the controller determines whether a dropout has been detected. This is done by determining whether DO_detected is set high or low. If it is set high, then ADP_active is also set high at step 540, indicating that automatic dropout protection is active.

Figure 6:
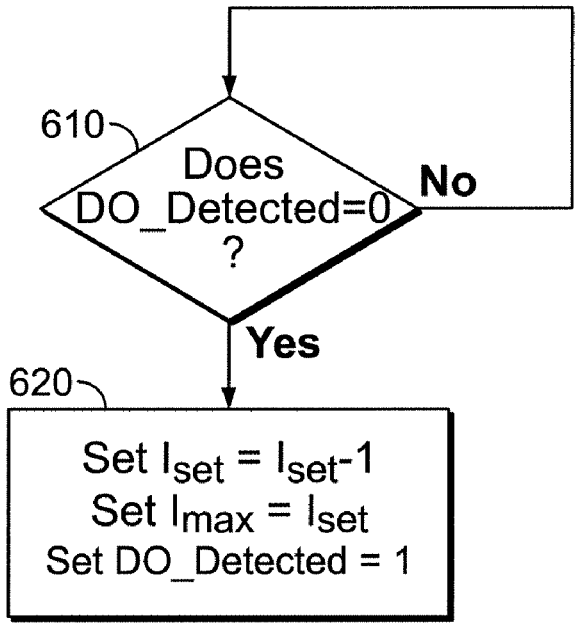
FIG. 6 illustrates a third portion of the method for preventing dropout in accordance with the fourth embodiment of the present invention.

In FIG. 6, the controller determines whether a dropout has been detected. This is done by determining whether the DO_detected register is set low at step 610. If it is, then an $I_{set}$ register is set to $I_{set-1}$, an $I_{max}$ register is set to $I_{set}$, and the DO_detected register is set low at step 620, wherein $I_{set}$ corresponds to the current set-point current data, $I_{set-1}$ corresponds to the next set-point current data, and Imax corresponds to the maximum output current produced by the second circuit. As such, $I_{max}$ is provided to the first circuit (as set-point current data) and used to produce the threshold voltage. For example, if $I_{set}$ is first set-point current, and $I_{max}$ is first set-point current data ($I_{max}=I_{set}$), and a dropout is detected, then $I_{set}$ would be changed to second set-point current data ($I_{set}=I_{set-1}$), $I_{max}$ would be changed to second set-point current data ($I_{max}=I_{set}$), and the dropout register (DO_detected) would be reset to low (or logic zero).

Figure 7:
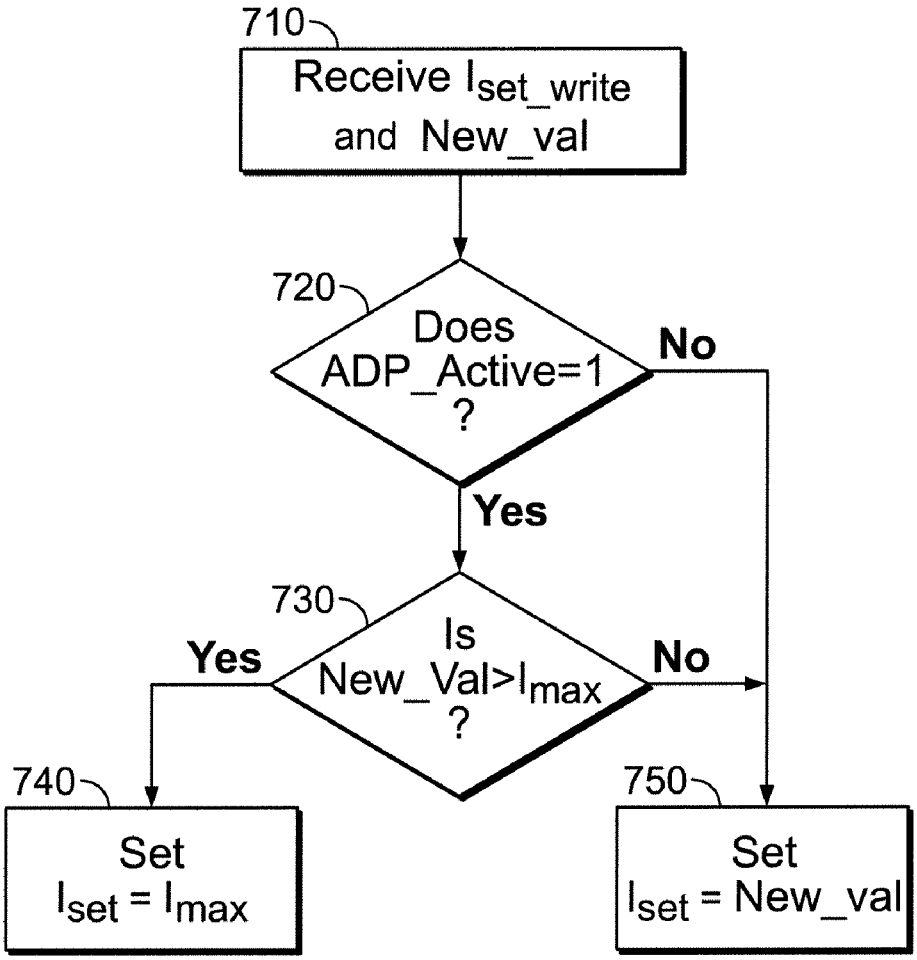
FIG. 7 illustrates a fourth portion of the method for preventing dropout in accordance with the fourth embodiment of the present invention.

In FIG. 7, at step 710, if a command is received (e.g., from an external device, a user interface, etc.) to change the output current ($I_{set_write}$), followed by the new output current (New_val), then at step 720, the controller determines whether the ADP_active register is set high. If it is set low (i.e., automatic dropout protection is inactive), then $I_{set}$ is set to the New_val at step 750. If it is high (i.e., automatic dropout protection is active), then the controller determines whether the New_val is greater than $I_{max}$ at step 730. If it is not, then $I_{set}$ is set to the New_val. If it is, then $I_{set}$ is set to $I_{max}$.

Having thus described several embodiments of a system and method for preventing automatic dropout in an LED current if an output current (or voltage) cannot be maintained, it should be apparent to those skilled in the art that certain advantages of the system and method have been achieved. It should also be appreciated that various modifications, adaptations, and alternative embodiments thereof may be made within the scope and spirit of the present invention. For example, instead of using set-point current data to set an output current, set-point voltage data could be used to set an output voltage. The invention is solely defined by the following claims.

What is claimed is:

1. An electronic circuit for preventing a dropout of a light-emitting diode (LED) current, comprising:

at least one LED;

a first circuit for receiving a reference voltage and set-point current data and for using the reference voltage and the set-point current data to produce a threshold voltage;

a second circuit electrically connected to the first circuit and the at least one LED, the second circuit receiving the threshold voltage, converting the threshold voltage into an output current, and providing the output current to the at least one LED, the second circuit comprising a comparator for comparing the threshold voltage to an output voltage corresponding to the output current and providing an output indicative of the relationship between the threshold voltage and the output voltage; and a logic controller electrically connected to the first and second circuits, the logic controller receiving the output of the comparator and providing second set-point current data to the first circuit if the output of the comparator indicates that the second circuit has not provided the output current, as set by the set-point current data;

wherein, if the second set-point current data is provided to the first circuit, then the first circuit uses the second set-point current data to produce a second threshold voltage, and the second circuit converts the second threshold voltage into a second output current and provides the second output current to the at least one LED, the second output current being less than the output current.

2. The electronic circuit of claim 1, wherein the first circuit comprises a plurality of multipliers, and wherein the set-point current data is used to activate corresponding ones of the plurality of multipliers to produce the threshold voltage, the threshold voltage being greater than the reference voltage.

3. The electronic circuit of claim 1, wherein the second circuit further comprises at least one buffer for providing the output voltage, the output voltage being substantially the same as the threshold voltage.

4. The electronic circuit of claim 1, wherein the second circuit further comprises at least one gain element for providing the output voltage, the output voltage being greater than and proportional to the threshold voltage.

5. The electronic circuit of claim 1, wherein the second circuit further comprises a voltage controlled current source for converting the output voltage into the output current, and for providing the output current to the at least one LED.

6. The electronic circuit of claim 1, wherein the output of the comparator is an analog signal.

7. The electronic circuit of claim 6, wherein the analog signal is at least digitally sampled and filtered to determine whether the second circuit can provide the output current, as set by the set-point current data.

8. The electronic circuit of claim 1, wherein the comparator comprises an error amplifier and the output of the error amplifier is a difference between the threshold voltage and the output voltage.

9. The electronic circuit of claim 1, wherein the comparator further provides a second output indicative of the relationship between a second output voltage corresponding to the second output current and the second threshold voltage, and the logic controller further provides third set-point current data to the first circuit if the second output indicates that the second circuit has not provided the second output current, as set by the second set-point current data, wherein the first circuit uses the third set-point current data to produce a third threshold voltage, and the second circuit converts the third threshold voltage into a third output current and provides the third output current to the at least one LED, the third output current being less than the second output current.

10. The electronic circuit of claim 9, wherein the comparator further provides a third output indicative of the relationship between a third output voltage corresponding to the third output current and the third threshold voltage, and the logic controller deactivates at least the first circuit if the third output indicates that the second circuit has not provided the third output current, as set by the third set-point current data.

11. A electronic circuit for preventing a dropout of a light-emitting diode (LED) current, comprising:

at least first and second LEDs;

a first circuit for receiving a reference voltage and set-point current data and for using the reference voltage and the set-point current data to produce a threshold voltage;

a second circuit electrically connected to the first circuit and the first LED, the second circuit receiving the threshold voltage, converting the threshold voltage into a first output current, and providing the first output current to the first LED, the second circuit comprising a first comparator for comparing the threshold voltage to a first output voltage corresponding to the first output current and providing a first output indicative of the relationship between the threshold voltage and the first output voltage;

a third circuit electrically connected to the first circuit and the second LED, the second circuit receiving the threshold voltage, converting the threshold voltage into a second output current, and providing the second output current to the second LED, the second circuit comprising a second comparator for comparing the threshold voltage to a second output voltage corresponding to the second output current and providing a second output indicative of the relationship between the threshold voltage and the second output voltage; and a logic controller electrically connected to the first, second and third circuits, the logic controller receiving the first output of the first comparator, receiving the second output of the second comparator, and providing second set-point current data to the first circuit if at least one of the first and second outputs indicate that at least one of the second circuit has not provided the first output current, as set by the set-point current data, and the third circuit has not provided the second output current, as set by the set-point current data;

wherein, if the second set-point data is provided to the first circuit, then the first circuit uses the second set-point current data to produce a second threshold voltage, the second circuit converts the second threshold voltage into a third output current and provides the third output current to the first LED, and the third circuit converts the second threshold voltage into a fourth output current and provides the fourth output current to the second LED, the third output current being less than the first output current, and the fourth output current being less than the second output current.

12. The electronic circuit of claim 11, wherein the first circuit comprises a plurality of multipliers, wherein the set-point current data is used to activate corresponding ones of the plurality of multipliers to produce the threshold voltage, the threshold voltage being greater than the reference voltage.

13. The electronic circuit of claim 11, wherein the second and third circuits each include at least one buffer for providing, respectively, the first and second output voltages, the first and second output voltages being substantially equal to the threshold voltage.

14. The electronic circuit of claim 11, wherein the second and third circuits each include at least one gain element for providing, respectively, the first and second output voltages, the first and second output voltages being greater than and proportional to the threshold voltage.

15. The electronic circuit of claim 11, wherein the second and third circuits each include at least one voltage controlled current source for converting, respectively, the first and second output voltages into the first and second output currents, and for providing, respectively, the first and second output currents to the first and second LEDs.

16. The electronic circuit of claim 11, wherein the first and second outputs of the first and second comparator are analog signals.

17. The electronic circuit of claim 16, wherein the analog signals are at least digitally sampled and filtered to determine whether the second circuit can produce the first output current, as set by the set-point current data, and whether the third circuit can produce the second output current, as set by the set-point current data.

18. The electronic circuit of claim 11, wherein the first and second comparators each include an error amplifier, and the first and second outputs of the error amplifiers are, respectively, differences between the threshold voltage and the first and second output voltages.

19. The electronic circuit of claim 11, wherein the logic controller is connected to the first and second comparators and receives the first and second outputs of the first and second comparators.

20. The electronic circuit of claim 11, further comprising a logic device electrically connected to the first and second comparators, the logic device receiving the first and second outputs of the first and second comparators and providing an output indicative of the relationship between the first and second output voltages and the threshold voltage, wherein the logic controller is electrically connected to the logic device and receives the output of the logic device.

21. The electronic circuit of claim 11, wherein the first comparator further provides a third output indicative of the relationship between a third output voltage corresponding to the third output current and the second threshold voltage, the second comparator further provides a fourth output indicative of the relationship between a fourth output voltage corresponding to the fourth output current and the second threshold voltage, and the logic controller further provides third set-point current data to the first circuit if at least one of the third and fourth outputs indicates that at least one of the second circuit has not provided the third output current, as set by the second set-point data, and the third circuit has not provided the fourth output current, as set by the second set-point data, wherein the first circuit uses the third set-point current data to produce a third threshold voltage, the second circuit converts the third threshold voltage into a fifth output current and provides the fifth output current to the first LED, and the third circuit converts the third threshold voltage into a sixth output current and provides the sixth output current to the second LED, the fifth output current being less than the third output current, and the sixth output current being less than the fourth output current.

22. The electronic circuit of claim 11, wherein the first comparator further provides a fifth output indicative of the relationship between a fifth output voltage corresponding to the fifth output current and the third threshold voltage, the second comparator further provides a sixth output indicative of the relationship between a sixth output voltage corresponding to the sixth output current and the third threshold voltage, and the logic controller deactivates at least the first circuit if at least one of the fifth and sixth outputs indicates that at least one of the second circuit has not provided the fifth output current, as set by the third set-point current data, and the third circuit has not provided the sixth output current, as set by the third set-point current data.

23. A method for preventing dropout of a light-emitting diode (LED) current, comprising:

providing set-point current data to a first circuit;

using a reference voltage and the set-point current data to produce a threshold voltage;

converting the threshold voltage into an output current;

providing the output current to at least one LED;

comparing the threshold voltage to an output voltage corresponding to the output current, and providing an output indicative of the relationship between the threshold voltage and the output voltage; and providing second set-point current data to the first circuit if the output indicates that the output current, as indicated by the set-point current data, has not been provided to the at least one LED;

wherein, if the second set-point current data is provided to the first circuit, then using the reference voltage and the second set-point current data to produce a second threshold voltage, converting the threshold voltage into a second output current, and providing the second output current to the at least one LED, the second output current being less than the output current.

24. The method of claim 23, wherein the step of using a reference voltage and the set-point current data to produce a threshold voltage further comprises using the set-point current data to activate corresponding ones of a plurality of multipliers to convert the reference voltage into the threshold voltage, the threshold voltage being greater than the reference voltage.

25. The method of claim 23, wherein the step of converting the threshold voltage into an output current further comprises converting the threshold voltage into the output voltage, and converting the output voltage into the output current, the output voltage being substantially the same as the threshold voltage.

26. The method of claim 23, wherein the step of converting the threshold voltage into an output current further comprises converting the threshold voltage into the output voltage, and converting the output voltage into the output current, the output voltage being greater than and proportional to the threshold voltage.

27. The method of claim 23, wherein the step of providing an output indicative of the relationship between the output voltage and the threshold voltage further comprises providing an analog signal indicative of the relationship between the output voltage and the threshold voltage, the output signal being digitally sampling and filtering.

28. The method of claim 23, further comprising comparing the second threshold voltage to a second output voltage corresponding to the second output current, and providing a second output indicative of the relationship between the second output voltage and the second threshold voltage.

29. The method of claim 28, further comprising providing third set-point data to the first circuit if the second output indicates that the second output current, as set by the second set-point current data, has not been cannot be provided to the at least one LED.

30. The method of claim 29, further comprising using the reference voltage and the third set-point data to produce a third threshold voltage, converting the threshold voltage into a third output current, and providing the third output current to the at least one LED, the third output current being less than the second output current.

* * * * *